United States Patent [19]

Urani

[11] Patent Number: 4,643,510

[45] Date of Patent: Feb. 17, 1987

[54] INDICATING FUSE HOLDER

[75] Inventor: Angelo Urani, St. Louis, Mo.

[73] Assignee: Cooper Industries, Inc., Houston, Tex.

[21] Appl. No.: 720,062

[22] Filed: Apr. 8, 1985

Related U.S. Application Data

[63] Continuation of Ser. No. 464,728, Feb. 7, 1983, abandoned.

[51] Int. Cl.[4] ..... H01R 13/50

[52] U.S. Cl. ..... 339/176 R; 339/258 F; 339/256 R

[58] Field of Search ..... 339/75 M, 75 R, 75 MP, 339/258 R, 258 F, 176 MP, 176 R, 256 R

[56] References Cited

U.S. PATENT DOCUMENTS

| | | | |
|---|---|---|---|
| 2,738,486 | 3/1956 | Wadsworth | 339/258 F |
| 3,156,841 | 11/1964 | Ayers | 339/258 F |
| 3,190,987 | 2/1965 | Fister | 200/121 |
| 3,199,065 | 8/1965 | Thompson | 339/258 F |
| 3,289,146 | 11/1966 | Tuchel | 339/258 F |
| 3,368,186 | 2/1968 | Benoit et al. | 339/258 F |
| 3,805,116 | 4/1974 | Nehmann | 339/258 R |
| 3,980,376 | 9/1976 | Rosen | 339/75 MP |
| 3,980,377 | 9/1976 | Oxley | 339/75 MP |

*Primary Examiner*—Gil Weidenfeld
*Assistant Examiner*—David Pirlot
*Attorney, Agent, or Firm*—Eddie E. Scott; Nelson A. Blish; Alan R. Thiele

[57] ABSTRACT

A fuse holder for an indicating fuse has a generally U-shaped body with a pair of spaced flexible electrically conductive side walls extending from a base and forming a cavity therebetween for receiving a fuse. An electrically conductive finger projects from each of the side walls into the cavity at an acute angle. Upon insertion of a fuse, between the free ends of the side walls opposite the base and into the cavity, the fingers are pivoted towards the respective side walls, and the side walls are deformed with the free ends thereof being rotated towards the fuse, such that electrical contact is made with the fuse at four different locations, by the two fingers and the ends of the two side walls.

4 Claims, 5 Drawing Figures

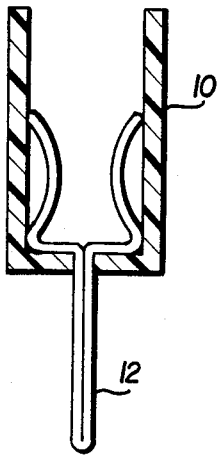
FIG. 1a
(PRIOR ART)
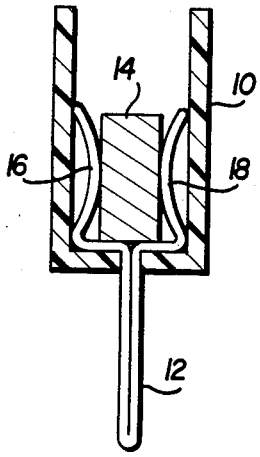
FIG. 1b
(PRIOR ART)
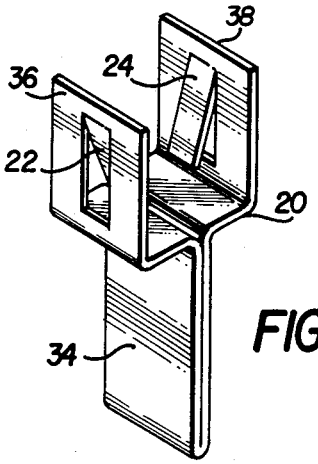
FIG. 2
FIG. 3a
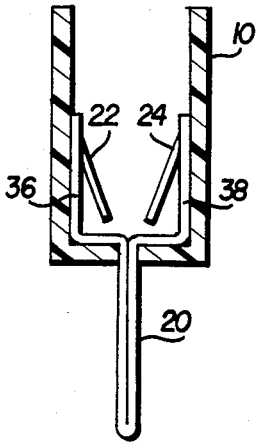
FIG. 3b
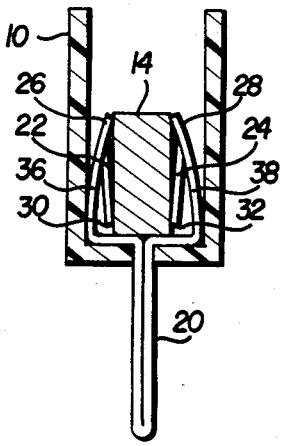

INDICATING FUSE HOLDER

This is a continuation application of application Ser. No. 464728, filed Feb. 7, 1983 now abandoned.

BACKGROUND OF THE INVENTION

This invention relates to improvements in fuse holders and more particularly to improvements in holders for indicating fuses.

An indicating fuse is used in an electrical circuit in which it is desirable to not only protect the circuit, but also, provide an indication of when the fuse has cleared or opened. An indicating fuse is releasably retained in an associated holder, such that an open fuse may be conveniently withdrawn from the holder, and a replacement fuse may be inserted in the holder. Electrical contact between the opposite sides of the indicating fuse and the confronting surfaces of the walls of the holder are made with insertion of the fuse into the holder.

Such an indicating fuse and its associated holder are shown and described in U.S. Pat. No. 3,190,987 to A. F. Fister, assigned to the assignee of the present invention. The fuse disclosed therein has generally rectangular terminals, which are contacted by the confronting convex wall surfaces of a generally U-shaped holder. This holder configuration provides two points of contact, one on each side for retaining the fuse. Experience has shown, however, that the two-point contact for retaining the fuse, suffers from difficulty in controlling the contact fit, between the fuse and the folder. Furthermore, repeated insertion and removal off the fuse, causes wear and deformation of the holder, resulting in loose contacts between the fuse and holder. This can result in decreased conductivity and increased heat build-up at the points of contact. In addition, retention of the fuse under conditions of vibration or mechanical shock is difficult to maintain.

SUMMARY OF THE INVENTION

The holder of the present invention provides four points of contact for an indicating fuse inserted therein. The holder comprises a generally U-shaped body, providing a retention cavity having flat substantially parallel side walls. Each side wall includes a finger projecting into the retention cavity and inclined at an acute angle to the supporting side wall. Upon insertion of a fuse, the fuse terminals first engage the fingers, and as insertion continues the fingers are caused to rotate, providing a lever action with the fingers forming the levers and the base of the fingers in the respective side walls forming the fulcrums. This action causes the free ends of the side walls to rotate inwardly and contact the fuse terminals. The fuse terminals are thus held by the confronting wall surfaces at four points, two points of contact provided by the fingers and an additional two points of contact provided by the free end surfaces of the side walls.

The improved fuse holder assures better control of the contact fit between the inserted fuse and the holder. Repeated insertion and removal of fuses will not deform the holder, resulting in loose contacts, thus assuring optimum conductivity and minimum heat build-up at the points of contact. Retention of the fuse in the holder when subjected to vibration mechanical shock is also assured.

An object of the present invention is a fuse holder for fuses having terminals on opposite sides thereof, wherein the holder provide four points of contact with the fuse terminals.

A further object of the present invention is a fuse holder for fuses having terminals on opposite sides thereof, providing improved control of contact fit, between the fuse and the holder.

Another object of the present invention is a fuse holder providing improved retention of a fuse under conditions of mechanical shock and vibration.

A still further object of the present invention is a fuse holder in which repeated insertion and removal of a fuse does not degrade the effective contact between the terminals on the fuse and the fuse holder.

Other objects, features and advantages of the present invention will become apparent with reference to the accompanying drawings and description.

BRIEF DESCRIPTION OF THE DRAWINGS

FIG. 1*a* is an end view, partially in cross-section, of a prior art fuse holder mounted in an insulating shell;

FIG. 1*b* is an end view, partially in cross-section, of the prior art fuse holder of FIG. 1*a* with an inserted fuse;

FIG. 2 is a perspective view of the fuse holder clip of the present invention;

FIG. 3*a* is an end view, partially in cross-section, of the fuse holder clip of FIG. 2 mounted in an insulating shell; and FIG. 3*b* is an end view, partially in cross-section, of the fuse holder clip of FIG. 2 mounted in an insulating shell with a fuse inserted therein.

DETAILED DESCRIPTION OF THE INVENTION

FIG. 1*a* illustrates a prior art fuse holder arrangement as, for example, is disclosed in the above-mentioned U.S. Pat. No. 3,190,987 to A. J. Fister. Fuse holder clip 12 is shown mounted in insulating shell 10. FIG. 1*b* shows the holder with a fuse terminal 14 inserted therein. Fuse terminal 14 is held in place by convex clip walls 16 and 18, which contact the fuse at only two points, one on each side of the fuse terminal.

The fuse holder of the present invention is illustrated in FIGS. 2, 3*a* and 3*b*. The fuse holder clip 20 comprises a generally U-shaped body having substantially parallel flat side walls 36 and 38, and a terminal shank 34, which serves as a means for external electrical connection into an electric circuit.

In the preferred embodiment, shown in FIG. 2, each side wall 36 and 38 is provided with a finger 22 and 24. The fingers are shown as partial cutouts from side walls 36 and 38, respectively. However, alternative embodiments of the side walls, and their respective fingers, are within the scope and spirit of the present invention. Fingers 22 and 24 are constructed from electrically conductive metal, having spring-like properties, whereby deformation due to stress when a fuse is inserted, causes a generally linear restoration force in the metal.

FIG. 3*a* shows the improved fuse holder 20 of the present invention mounted in an insulating shell 10. Fingers 22 and 24 are shown directed into the cavity formed by the U-shaped body portion of holder 20, as described herein above.

FIG. 3*b* shows the improved fuse holder 20 of the present invention mounted in the insulating shell 10 with an indicating fuse terminal 14 inserted therein. Insertion of fuse terminal 14 causes fingers 22 and 24 to be rotated outwardly towards the side walls 36 and 38, respectively, due to contact at the finger ends 30 and 32 with the fuse terminal 14. Fingers 22 and 24 act as lever means, using side walls 36 and 38, respectively, as fulcrums and the extension of the lever means, causing the respective side walls to be deformed and the free ends 26 and 28 of the side walls to rotate inwardly into contact with fuse terminal 14. This provides a four-point retention of fuse terminal 14 by holder clip 20. In other words, fuse terminal 14 is retained in the holder by contact with finger ends 30 and 32, and by contact with wall ends 26 and 28. Preferably, the base of each of the fingers 22 and 24 is spaced a predetermined distance form the free ends 26 and 28 of the respective side walls 36 and 38 to assure that upon insertion of the fuse the free ends 26 and 28 of the respective side walls 36 and 38, will firmly contact the respective surfaces of fuse terminal 14.

It will be readily understood, by one skilled in the art, that the fuse holder of the present invention, provides improved retention of a fuse, even under adverse conditions, including vibration and mechanical shock. The fuse holder of the present invention provides greater resistance to loosening of contact with the fuse caused by wear and provides improved control of contact fit.

The drawings and description of the present invention, set forth herein, show and describe the preferred embodiment of the invention. However, it should be understood that modifications and changes may be made without departing from the spirt and intent of the invention disclosed and claimed.

What is claimed is:

1. A fuse holder for an indicating fuse comprising:

(a) a generally U-shaped clip body having a base and first and second spaced side walls each extending from a base up to free ends, said side walls forming a cavity therebetween for receiving a fuse terminal inserted between said free ends of said side walls opposite said base and into said cavity, at least said first of said side walls being flexible and pivotable about a single axis and formed from an electrically conductive material, said first of said side walls being substantially flat when no fuse is within said cavity, said free end of said first side wall opposite said base being free to move into said cavity; and (b) electrically conductive lever means having a first end rigidly disposed intermediate said free end of said first side wall and having a second end projecting from said first side wall intermediate said base and projecting from said first side wall into said cavity at an acute angle with respect to said first side wall and towards said base;

said second end being spaced from said base such that upon insertion of a fuse terminal into said cavity said fuse terminal initially contacts said second end of said lever means causing said first end of said lever means upon continued insertion of said fuse terminal to pivot towards said first side wall, causing said first side wall to deform such that said free end of said first side wall contacts said fuse terminal and said lever means is rotated to be substantially parallel with said fuse terminal and in electrical contact therewith such that, upon completion of insertion of said fuse, two points of contact therewith are established, one of said points being at said lever means and the other of said points being at said first side wall.

2. The fuse holder, according to claim 1, wherein each of said lever means is mounted on the respective side wall at a predetermined distance from the free end thereof.

3. The fuse holder according to claim 1 wherein both said first and second side walls are flexible, formed from electrically conductive material and are substantially flat and substantially parallel to each other when no fuse is within said cavity, said lever means being mounted on and projecting from each of said side walls whereby said fuse terminal is contacted by each of said lever means and said free ends of said side walls at opposite sides, respectively, of said fuse terminal.

4. The fuse holder, according to claim 3, wherein each of said lever means comprises a cutout portion of the respective side wall, which projects into said cavity at an acute angle from a portion of said side wall adjacent said free end of the respective side wall.

* * * * *